United States Patent [19]

Edstrom

[11] Patent Number: 4,807,841

[45] Date of Patent: Feb. 28, 1989

[54] OMNIDIRECTIONALLY TILTING AND SWIVELLING SUPPORT MECHANISM FOR CHAIRS OR THE LIKE

[75] Inventor: Andrew Edstrom, San Jose, Calif.

[73] Assignee: Serge Abend, Palto Alto, Calif. ; a part interest

[21] Appl. No.: 171,568

[22] Filed: Mar. 22, 1988

[51] Int. Cl.[4] ..... F16M 13/00

[52] U.S. Cl. ..... 248/580; 248/160; 248/581

[58] Field of Search ..... 248/580, 581, 149, 160, 248/161, 596, 583, 608, 604, 622, 181, 372.1; 297/314

[56] References Cited

U.S. PATENT DOCUMENTS

| | | | |
|---|---|---|---|
| 1,678,668 | 7/1928 | Collier | 297/326 X |
| 1,723,415 | 8/1929 | Ferris | 248/596 |
| 2,048,148 | 7/1936 | Stoll | 248/583 |
| 3,669,399 | 6/1972 | Wager | 248/608 X |
| 4,099,697 | 7/1978 | Von Schuckmann | 297/314 X |
| 4,099,697 | 7/1978 | Von Schuckmann | 248/604 |
| 4,185,803 | 1/1980 | Kalvatn | 248/608 |
| 4,236,752 | 12/1980 | Mizelle | 248/608 X |
| 4,371,142 | 2/1983 | Bottemiller et al. | 248/622 X |
| 4,425,863 | 1/1984 | Cutler | 297/314 X |
| 4,431,157 | 2/1984 | Arild | 248/583 |
| 4,498,656 | 2/1985 | Arild | 248/608 |

FOREIGN PATENT DOCUMENTS

| | | | |
|---|---|---|---|
| 2159869 | 6/1973 | Fed. Rep. of Germany | 297/314 |

*Primary Examiner*—Ramon O. Ramirez

[57] ABSTRACT

An omnidirectionally tilting pedestal mechanism for supporting a chair seat, including a tubular pedestal member, first and second tilt/swivel assemblies, each mounted within the pedestal member for limited tilting movement, a flexure shaft for connecting the first and second tilt/swivel assemblies within the pedestal member, and mounting means for connecting the flexure shaft to a chair seat, such that as the chair seat is tilted, the deflection force acts to tilt one end of the flexure shaft within one of the tilt/swivel assemblies for bowing the flexure shaft between the first and second tilt/swivel assemblies.

22 Claims, 3 Drawing Sheets

OMNIDIRECTIONALLY TILTING AND SWIVELLING SUPPORT MECHANISM FOR CHAIRS OR THE LIKE

FIELD OF THE INVENTION

The present invention relates to tiltable and swivellable chairs and, more particularly, to an inexpensive and compact mechanism for supporting a chain seat for tilting movement forward and backward, side-to-side, and all directions in between.

BACKGROUND OF THE INVENTION

Tilting mechanisms for the seat of a chair are well known. Typically, such mechanisms allow only rearward tilting and employ an adjustable spring-like mechanism to return the seat to a generally horizontal position when the chair is not in use. Chairs such as these are in common use and have the advantage, over rigid chairs, that the occupant may shift his position in order to transfer the pressure of sitting from one part of his anatomy to another. This shifting is found to be relaxing and aids in postponing or even preventing tension and fatigue.

Improvements over one direction tilting are to be found in U.S. Pat. No. 1,678,668 wherein there is disclosed a chair tilting mechanism which tilts forwardly as well as backwardly and in U.S. Pat. No. 1,723,415 wherein there is disclosed a chair tilting mechanism which is capable of a limited lateral rocking or tilting movement.

Further improvements are to be found in omnidirectionally tiltable chair mechanisms which are described in U.S. Pat. Nos. 2,048,148 (Stoll), 4,099,697 (Von Schuckmann), 4,185,803 (Kalvatn), 4,431,157 (Arild) and 4,498,656 (Arild). The Stoll patent discloses a ball joint surrounded by a coil spring which is held in compression between a flange and a seat mounted swivel bearing. A stub shaft extends between the ball and the swivel bearing. As the occupant's weight is shifted on the seat, tilting can occur in any direction. As soon as the lateral thrust force is relieved, the seat will return to its neutral, home position. This mechanism may be interposed between a standard pedestal tube and the chair seat. In the Von Schuckmann patent the omnidirectionally tilting mechanism must be located in a dedicated base. It comprises a ball received in a socket for universal movement with a shaft secured to and extending from the ball-like member. A star-like array of generally radial tension springs are attached to the shaft and yieldably resist deflection of the shaft out of its normal position in all directions. The patented Kalvatn mechanism comprises a pair of concentric rings which are mutually moveable, each about a torsion bar. This universal tilting mechanism may also be mounted between the chair seat and the standard pedestal. Similarly, in each of the Arild patents there is disclosed a tilting mechanism comprising a pair of torsion bar elements mounted upon yokes disposed normally to one another. Again, these mechanisms may be mounted between the seat and the standard pedestal.

All of the known omnidirectionally tiltable chair support structures are of a size and complexity to require extensive modifications to existing chair structures for their incorporation therein.

It is the object of the present invention to provide an improved mechanism, utilizing a flexure member, for supporting a chair seat such that the seat is tiltable and self righting in a full 360 degrees. Optionally, the seat may also be mounted to swivel a full 360 degrees.

It is a further object of the present invention to provide an omnidirectionally tiltable mechanism which may be mounted totally out of sight and which fits completely within a general standard, central tubular column of any chair support.

SUMMARY OF THE INVENTION

These and other objects may be carried out, in one form, by providing an omnidirectionally tilting pedestal mechanism for supporting a chair seat, including a tubular pedestal member, first and second tilt/swivel assemblies, each mounted within the pedestal member for limited tilting movement, a flexure shaft for connecting the first and second tilt/swivel assemblies within the pedestal member, and mounting means for connecting the flexure shaft to a chair seat, such that as the chair seat is tilted, the deflection force acts to tilt one end of the flexure shaft within one of the tilt/swivel assemblies for bowing the flexure shaft between the first and second tilt/swivel assemblies.

BRIEF DESCRIPTION OF THE DRAWINGS

Other objects and further features and advantages of my invention will be apparent from the following, more particular, description considered together with the accompanying drawings, wherein.

DETAILED DESCRIPTION OF THE ILLUSTRATED EMBODIMENTS

Figure 1A:
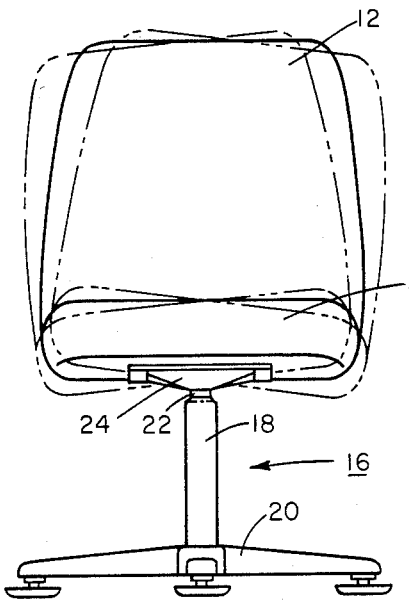
FIGS. 1A and 1B are schematic front and side elevation views of a chair incorporating the tilt/swivel mechanism according to my invention.
Figure 1B:
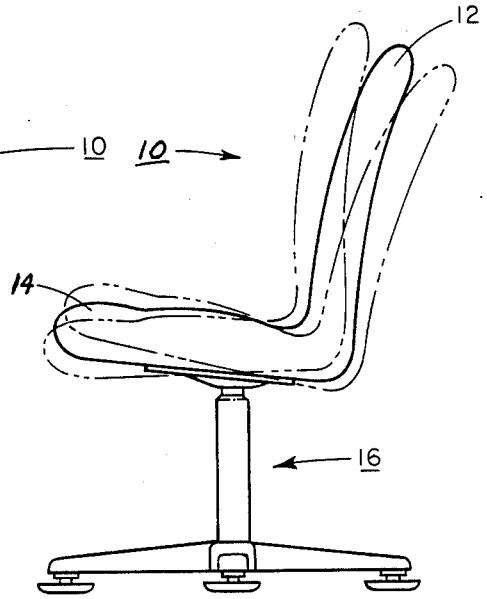

Referring to FIGS. 1A and 1B, there is shown a chair 10 having a back 12, a seat 14 and a pedestal 16, comprising an upright column in the form of a generally standard sleeve 18 and a leg assembly 20. The configurations of the seat and back are matters of design choice and a wide variety of designs can be employed. A support shaft 22 extends outwardly from the upper end of the pedestal 16 and it is rigidly connected to the bottom of seat 14 by means of a suitable bracket 24. The mechanism of my invention is housed within sleeve 18 for allowing an occupant, sitting on the seat, to selectively tilt forward and backward, as indicated by the phantom lines in FIGURE 1B, side-to-side, as indicated by the phantom lines in FIG. 1A, and in all directions therebetween, i.e. omnidirectionally. Additionally, the occupant may swivel the seat a full 360 degrees.

The pedestal sleeve 16 is generally cylindrical and in standard pedestal chairs supports the thrust load of the occupant's weight. In my invention I have taken great care to design the interacting elements so as to fit within the confines of the generally standard sleeve dimensions. Of course, there are variations from manufacturer to manufacturer, but the overall aesthetically appealing dimensions fall within narrow limits. In order to allow chair manufacturers to continue to provide to their customers the clean lines presently employed in their designs and to further provide the highly desirable features of omnidirectional tilting and swivelling, my mechanism has been made compact.

Figure 2:
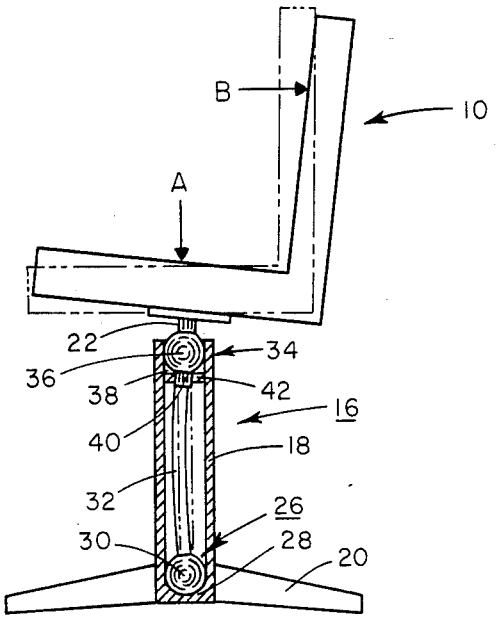
FIG. 2 is a schematic side elevation view with the pedestal column cut away to reveal a first form of the mechanism according to my invention, wherein a flexure shaft carries the thrust load.

In FIG. 2 the mechanism enclosed by the sleeve 18 is revealed in schematic form. At the base of the sleeve there is a lower pivot assembly 26 comprising a concave bearing support member 28 adapted to pivotably support a ball-like member 30. The bottom of a resiliently flexible shaft 32 is secured to the ball-like member, and the top end of the shaft extends to an upper pivot assembly 34 at the upper end of the sleeve 18. Pivot assembly 34 comprises a second ball-like member 36 secured on flexure shaft 32, confined radially in a bushing 38 in the sleeve. A limit stop stub shaft 40 extending from the second ball-like member interferes with an internal flange 42, within the sleeve, whose inner diameter defines the limits of tilting. The seat support shaft 22 is also carried by the second ball-like member 36. For simplicity of description, I refer to the upper and lower tilt/-swivel assemblies as pivot assemblies. However, it should be understood that absent some arresting means for preventing swivelling, as will be described, the flexure shaft 32 is free to tilt in all directions and swivel a full 360 degrees.

As identified by arrow A, the thrust load of the occupant's weight is carried directly downwardly through the flexure shaft 32 to the load bearing lower pivot assembly 26, through the bottom of the sleeve 18 and the leg assembly 20 to the floor. As the seated occupant moves naturally therein, as by shifting his weight, a deflection load (in any direction), identified by arrow B will be generated for flexing the shaft 32 and creating a bow therein between the first pivot assembly 26 and the second pivot assembly 34. A constant righting force will always return the seat to its neutral position once the deflection load is released. Although the tilting angle is a matter of design choice, in practice, the limit of tilt should be in the range of about five to eight degrees, in order to balance the comfort of the occupant and the flexural lifetime of the shaft 32. I have found that for use in static applications, such as in the office or at home, the five degree limit is satisfactory. However, for dynamic applications, such as in sports boats or other moving and rocking environments, a greater tilt limit stop is desirable so as to allow the flexure shaft to right itself before the limit stop is reached. This tends to cushion dynamic loads rather than allowing the shaft to "bottom out" at the limit stops. The comfort level of the occupant will also be determined by the ease of flexure of the shaft, as generally determined by the material, diameter and free length of the shaft.

Figure 3:
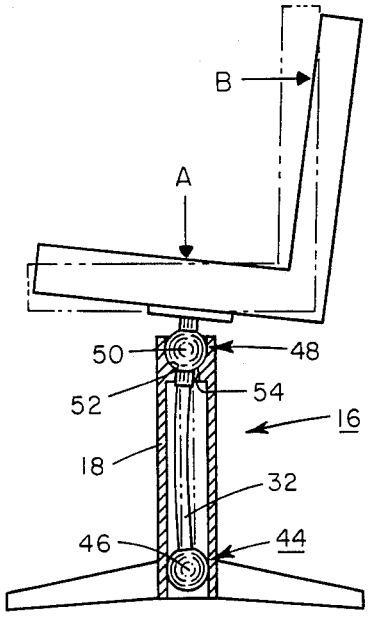
FIG. 3 is a schematic view similar to FIG. 2 showing an alternative form of the mechanism according to my invention, wherein the pedestal sleeve carries the thrust load.

In the form of my invention illustrated in FIG. 3, the lower pivot assembly 44 carries no thrust load. It merely provides a ball-like member 46 upon the end of flexure shaft 32 which is constrained for rotating and tilting, relative to the interior of the sleeve 18. At the upper end of the shaft, a load bearing upper pivot assembly 48, comprising a ball-like member 50 supported by a concave seat 52 in the sleeve, transmits the thrust load of the occupant through the ball-like member 50 to and through the sleeve to the leg assembly 20. The concave seat 52 has a central aperture 54 through which the shaft extends, with the walls of the aperture providing a limit stop for defining the maximum angle of tilt of the shaft.

By allowing the lower pivot assembly to be free of bearing a thrust load I am able to provide the occupant with a flexure adjustment. This can be seen in FIG. 4 wherein the principle of flexure adjustment of this device is schematically illustrated. Adjustment mechanism 56 comprises the entire lower pivot assembly with the shaft 32 extending completely through and slideable within an opening in ball-like element 58, which rotates within the concave seat of bushing 59, axially moveable within the sleeve. A handle extension 60 passes through an opening 62 in the sleeve 18, to be manipulated by the occupant. The opening may extend axially (as shown) or it may take the shape of a helix so as to prevent the adjustment mechanism 56 from shifting. As the adjustment mechanism is axially moved along the shaft 32, its free length will be changed. By shortening the free flexural length, the deflection force will have to be increased and the occupant will experience a more firm seat. Conversely, as the free flexural length is increased, the deflection force will be decreased and the occupant will experience a more soft seat. Simultaneously, the occupant may swivel the chair seat a full 360 degrees.

Having described the basic principles of operation of my novel omnidirectionally tiltable chair mechanisms I will describe the preferred structures of the flexure elements housed within the pedestal sleeve, in greater detail. It should be borne in mind, however, that many structural changes and alternatives are possible within the purview of my invention.

Figure 5:
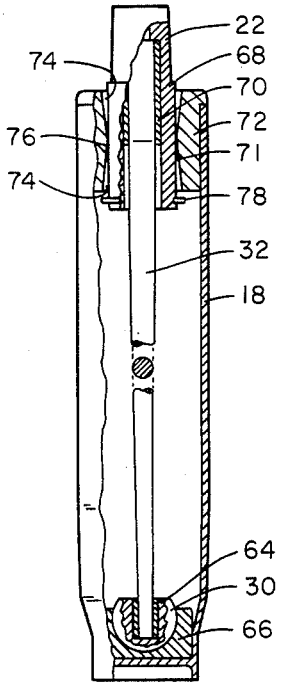
FIG. 5 is a sectional elevation view showing one form of the structural elements for the omnidirectionally tilt/swivel mechanism of the FIG. 2 embodiment.

The FIG. 5 pedestal column is comparable to the device schematically shown in FIG. 2 wherein the thrust load is carried directly by the flexure shaft 32. A metal ball 30, press fit on the shaft via plastic sleeve 64, seats in the spherical cavity of plastic socket bushing 66 maintained in the base of sleeve 18 which transmits the thrust load to the floor by way of the leg assembly 20. A collar 68 press fit to the upper end of the shaft 32 via plastic sleeve 70, has a larger diameter pivot portion 71 and a smaller diameter stub portion which serves as the support shaft 22 for being mounted to the seat bracket 24. The upper pivot seal and limit stop are formed by a bushing 72, preferably made of plastic, such as Delrin, pressed into the upper end of the sleeve 18 and having a double conically tapered inner surface 74. The circle of convergence 76 of the conical surfaces defines the upper pivot axis which is slightly larger than the diameter of the pivot portion 71 so that as the shaft bows and the pivot portion tilts within the bushing 72, the conical surfaces 74 present omnidirectional limit stops to the pivot portion 71. As stated above, the limit stops are set to allow no more than a five to eight degree tilt of the end of the flexure shaft. A snap ring 78 secured in a groove at the end of the collar 68 prevents the elements from coming apart when the chair is lifted by the seat. It should be noted that the collar must be long enough to locate the snap ring far enough away from the bottom of the bushing 72 to prevent interference between these elements at the limits of tilting.

Figure 6:
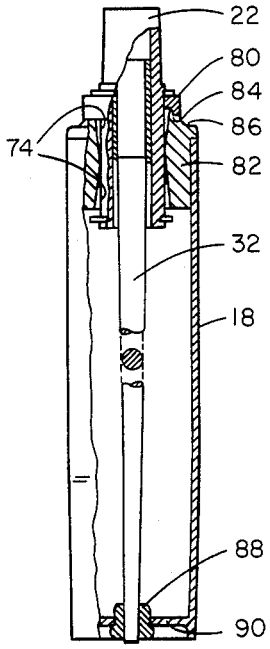
FIG. 6 is a sectional elevation view showing one form of the structural elements for the mechanism of the FIG. 3 embodiment.

The FIG. 6 pedestal column is comparable to the device schematically shown in FIG. 3. The thrust load is carried from the support shaft 22, outwardly through a metal cap 80, onto bushing 82 and then to the pedestal sleeve 18 and through the leg assembly 20 to the floor. The metal cap 80 has an interior conical surface 84 which seats upon a spherical surface 86 formed on the top of bushing 82. The double conically tapered inner surface 74 of the upper pivot assembly is the same as that shown in FIG. 5. At the opposite end of the flexure shaft, a similar but smaller pivot assembly comprises a double conically tapered plastic bushing 88 held in place in the bottom of pedestal sleeve 18 by an internal flange 90. The end of the flexure shaft 32 passes through the bushing 88 and is free to slide axially therein as its body is bowed under the deflection load.

In describing both the load supporting shaft and load supporting sleeve embodiments of my invention, I have referred to the flexure shaft as being a cylindrical length of spring stock. However, I have determined that by tapering the shaft as illustrated in FIGS. 5 and 6 it is possible to considerably shorten the tilting mechanism as compared to cylindrical shafts of the same maximum diameter. For example, a cylindrical chrome-silicon steel flexure shaft of 0.4375 inches in diameter would have to be 12.5 inches in free length (i.e. between the pivot assemblies) to yield the same flexure strength as a tapered chrome-silicon steel flexure shaft having diameters of 0.4375 inches at one free end and 0.21875 inches at the other free end and a free length of 7 inches. Clearly, if one were to construct a drafting stool or other such elevated seat, the cylindrical flexure shaft would be an attractive choice because it requires less machining, and is therefore less expensive. However, since an important feature of my invention is to enable my omnidirectionally tilting mechanism to be installable within standard pedestal sleeves, one way that I accommodate my mechanism for the shorter sleeve usually found in a standard chair pedestal is to use a tapered flexure shaft.

Figure 7:
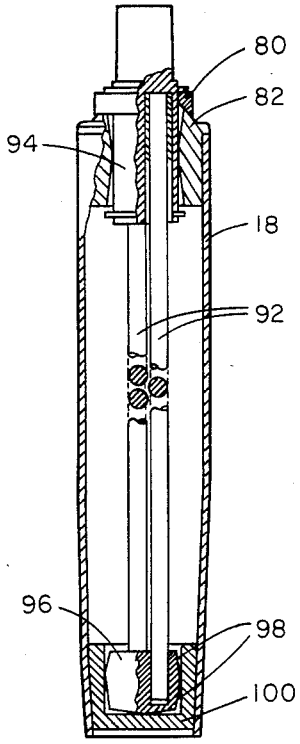
FIG. 7 is a sectional elevation view showing another form of the structural elements for the mechanism of the FIG. 3 embodiment.

Another alternative configuration which allows me to shorten the length of my omnidirectionally tilting and swivelling mechanism is shown in FIG. 7. In this embodiment, multiple cylindrical flexure shafts 92 may be used. Since the multiple shafts share the flexure stress, each one sees less stress, allowing each to be of smaller diameter and shorter length. The upper end of this configuration is virtually the same as that shown in FIG. 6 with the exception that each of the multiple shafts 92 is press fit into a plastic liner fitted into a hole bored into the collar 94. The bottom end of each of the shafts is confined, for sliding movement, in an opening in a plastic pivot bushing 96, having a double conical taper outer diameter 98. The bushing 96 is, in turn, supported in plastic seat 100 which is pressed into the bottom of pedestal sleeve 18. When I have two plastic parts moving against one another, I have found it to be satisfactory to make one of Delrin and the other of Nylon. As the surfaces of the shafts are laterally loaded during the bowing action, their friction in the bushing 96 damps, or cushions, the tilt action perceived by the occupant, as compared with the somewhat more springy action of the single shaft embodiments. I have made a tilting mechanism in accordance with the principles of my invention including a bundle of thirty shafts, each 0.125 inches in diameter and having a four inch free length.

Figure 4:
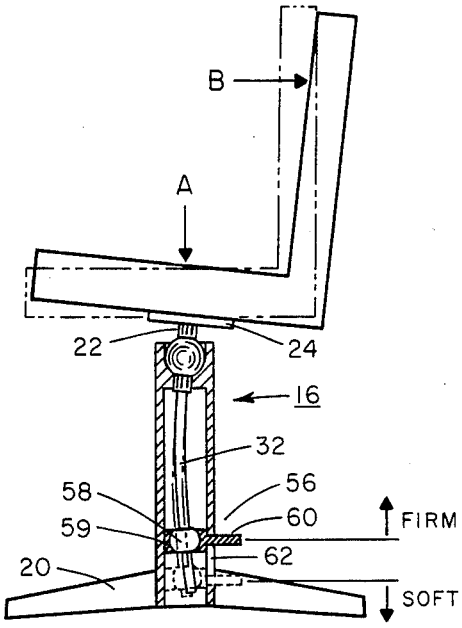
FIG. 4 is a schematic view similar to FIG. 3 showing means for adjusting the flexure force of the tilting mechanism.
Figure 8:
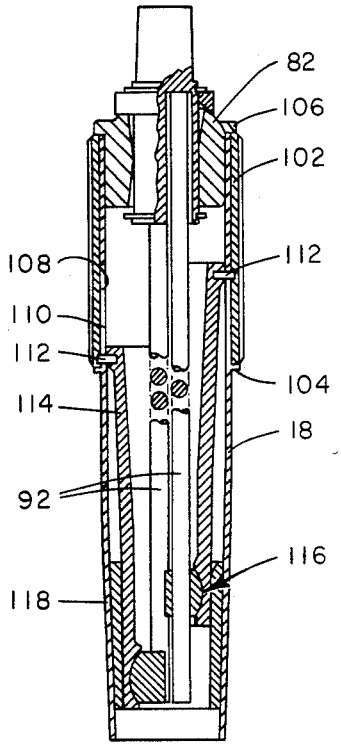
FIG. 8 is a sectional elevation view showing the structural elements for the mechanism of the FIG. 4 embodiment.

I have described, in general terms, the flexure adjustment capability of my mechanism with respect to the schematic representation of FIG. 4. In FIG. 8 the specific details of construction of one such device are shown. It should be noted that although I have chosen to illustrate this feature in the context of a multiple shaft, load supporting sleeve configuration, these limitations should not be considered to be constraints on the various alternative forms for carrying out this feature. The upper end of this embodiment is virtually the same as that shown in FIG. 7, with the exception that an outer rotatable adjustment sleeve 102 surrounds the pedestal sleeve 18, and is held against axial movement between flange 104, on the pedestal sleeve 18, and flange 106, on the bushing 82. The outer surface of the adjustment sleeve may be knurled for ease of handling, and the inner surface has a helix groove 108 cut therein (represented by dotted lines). An axially extending slot 110 cut through the pedestal sleeve 18 passes a pin 112 which seats in the helix groove, so that as the adjustment sleeve is rotated, the pin will be moved axially, in one direction on the other, depending on the direction of rotation. The pin 112 is secured to, and drives, an axially moveable internal sleeve 114 which carries the lower pivot assembly 116 at its end and slides within low friction sleeve 118 press fit in the pedestal sleeve 18. As the adjustment sleeve is rotated and the lower pivot assembly is raised, the free length of the flexure shafts decrease and flexure becomes stiffer (shown on the right half of this drawing). Conversely, as the adjustment sleeve is rotated and the lower pivot assembly is lowered, the free length of the flexure shafts increase and flexure becomes easier (shown on the left half of this drawing).

Figure 9:
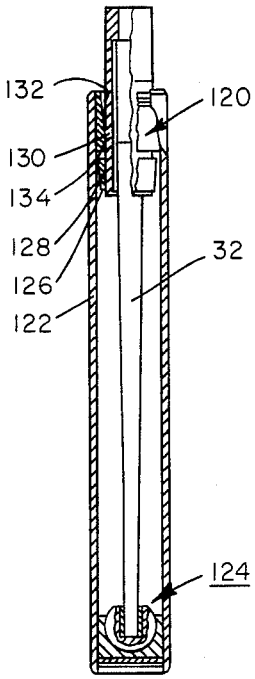
FIG. 9 is a sectional elevation view of another form of the structural elements of the mechanism for the FIG. 2 embodiment, showing a small diameter assembly particularly adaptable for use in an adjustable height pedestal.
Figure 10:
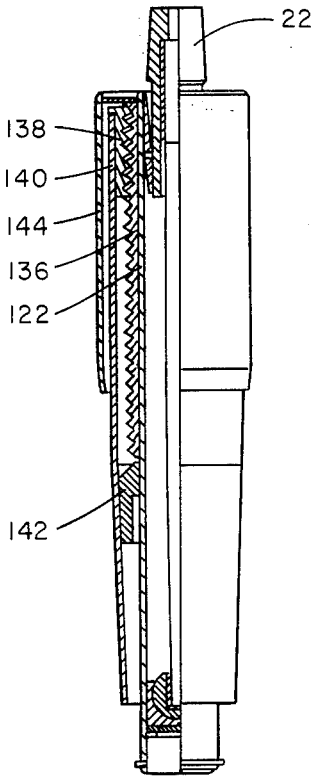
FIG. 10 is a sectional elevation view of an adjustable height pedestal incorporating the mechanism of FIG. 9.

In yet another embodiment of my invention I have provided a height adjusting device. Since it is important in the practical application of my invention that the pedestal sleeve be interchangeable with those generally in commercial use today, and since height adjustment requires two mutually slideable sleeves, I designed a much smaller diameter flexure assembly so that it will fit inside an outer, decorative height adjusting sleeve. In FIGS. 9 and 10 I have illustrated the smaller diameter flexure mechanism and the adjustable height pedestal system incorporating the smaller flexure mechanism. In order to reduce the diameter, I have redesigned upper pivot assembly 120. The lower pivot assembly 124 is virtually the same as its counterpart in FIG. 5 (load supporting shaft). The double conically tapered surface of the upper pivot assembly 120 is made up of two pieces. One tapered surface 126 is formed on the outer diameter of sleeve 128 which snaps into a groove in collar 130, and the other tapered surface 132 is formed on the inner diameter of sleeve 134 which is snaps into a groove in the upper end of interior sleeve 122. By assembling the upper pivot in this manner I have been able to overlap the two portions of the tilting and swivelling mechanism so that the flexure shaft 32 is held in place when the chair is lifted. In the FIG. 5, larger diameter, form of this assembly, snap ring 78 on the lower end of collar 68 performs this same function but requires much more interior space to prevent interference as the flexure shaft 32 bows.

To complete the height adjusting device as shown in FIGURE 10, a threaded sleeve 136 (preferably made of plastic) is press fit over the interior sleeve 122 and engages a threaded bushing 138 (also made of plastic) press fit within pedestal sleeve 140. A lower guide 142 is also secured within the pedestal sleeve to maintain the concentricity of the sleeves 122 and 140. An outer manually moveable decorative sleeve 144 is welded to interior sleeve 122 at its upper end for rotating that member. As the interior sleeve is rotated the mating threaded surfaces 136 and 138 drive it vertically upwardly or downwardly to raise and lower the seat 14. Alternative elevating mechanisms can take the form of hydraulic, pneumatic or well known gas devices adapted for my structure.

Figure 11:
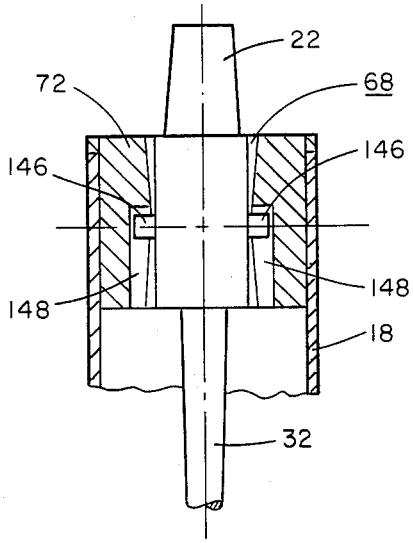
FIG. 11 is partial sectional view showing an omnidirectionally tiltable but non-swivelling assembly.

In FIG. 11 I illustrate means, which can be substituted for the upper pivot, to prevent swivelling of the seat 14. It comprises a pair of diametrically opposed cylindrical pins 146 extending outwardly from the collar 68 which coacts with the double conically tapered bushing 72. A pair of close fitting slots 148 formed in the bushing 72 confine the pins. By locating the pins directly on or near the tilt plane and extending the slots to allow the pins to tilt with the shaft, it is possible to prevent swivelling while retaining the full tilting features. Although two pins are shown, this feature may be implemented with but a single pin in a single slot.

It should be understood that the present disclosure has been made only by way of example, and that numerous changes in details of construction and the combination and arrangement of parts may be resorted to without departing from the true spirit and the scope of the invention as hereinafter claimed.

What is claimed is:

1. An omnidirectionally tiltable pedestal mechanism for supporting a chair seat, or the like, comprising a pedestal member extending in a supporting direction, elongated flexure means disposed within the confines of said pedestal member and extending in said direction, first and second support means, spaced from one another in said direction and mounted between said flexure means and said pedestal member, for allowing said flexure means to tilt and swivel within said pedestal member, and mounting means for connecting said flexure means to a chair seat, or the like, such that as said mounting means is tilted, the deflection force acts to tilt one end of said flexure means for deflecting said flexure means between said first and second spaced support means.

2. The mechanism as defined in claim 1 wherein as said flexure means receives a thrust load applied in a substantially axial direction along said flexure means, the thrust load is carried from one end of said pedestal member to the other end by said flexure means.

3. The mechanism as defined in claim 2 wherein said second support means is positioned in the lower end of said pedestal member and comprises a ball-like member mounted upon said flexure means and a partially spherical seat for receiving said ball-like member.

4. The mechanism as defined in claim 1 wherein as said flexure means receives a thrust load applied in a substantially axial direction along said flexure means, the thrust load is transferred through said first support means, located at the upper end of said pedestal member, to the upper end of said said pedestal member, and is carried from the upper end of said pedestal member to the lower end by said pedestal member.

5. The mechanism as defined in claim 2 or 4 wherein said flexure means comprises a cylindrical shaft of spring stock.

6. The mechanism as defined in claim 2 or 4 wherein said flexure means comprises a tapered shaft of spring stock.

7. The mechanism as defined in claim 2 or 4 wherein said flexure means comprises a plurality of shafts of spring stock.

8. The mechanism as defined in claim 7 wherein each of said plurality of shafts is cylindrical.

9. The mechanism as defined in claim 1 further including adjustment means for altering the flexural rigidity of said flexure means.

10. The mechanism as defined in claim 9 wherein said adjustment means comprises means for moving one of said support means relative to the other along said flexure means for changing the free length of said flexure means.

11. The mechanism as defined in claim 1 wherein said pedestal member comprises a tubular sleeve and further comprising an outer sleeve encircling said tubular pedestal member and height adjusting means for moving said tubular pedestal member axially with respect to said outer sleeve for changing the overall height dimension of said combined pedestal member and outer sleeve.

12. The mechanism as defined in claim 11 wherein said height adjusting means comprises a first threaded member secured to said pedestal member, a second threaded member secured to said outer sleeve and rotation means for moving said first and second threaded members relative to one another.

13. The mechanism as defined in claim 1 wherein one or both of said support means comprises a double conically tapered bushing encircling said flexure means and wherein the conical surfaces of said bushing define the limits of tilting of said flexure means.

14. The mechanism as defined in claim 1 wherein one of said support means is provided with motion constraining means for preventing said flexure member from swivelling within said pedestal member.

15. The mechanism as defined in claim 1 wherein limit stop means is provided to limit the amount of tilt of said flexure means relative to at least one of said support means.

16. An omnidirectionally tiltable mechanism for a chair seat, or the like, comprising a tubular pedestal member, flexure means housed within said pedestal member, upper pivot means positioned within said pedestal member and connected between the upper end of said flexure means and said pedestal member for allowing said upper end to tilt and swivel, and lower pivot means positioned within said pedestal member and connected between the lower end of said flexure means and said pedestal member for allowing said lower end to tilt and swivel, said upper and lower pivot means defining the free length of said flexure means which is capable of bowing therebetween as a lateral deflection load is applied to tilt one end of said flexure means, and which returns it to a neutral, unstressed, condition when said deflection load is removed.

17. The mechanism as defined in claim 16 further comprising adjustment means for altering the flexural rigidity of said flexure means, said adjustment means comprising means for moving said lower pivot means for changing the free length of said flexure means.

18. The mechanism as defined in claim 16 further comprising an outer sleeve encircling said pedestal member and height adjusting means for moving said said pedestal member axially with respect to said outer sleeve for changing the overall height dimension of said combined pedestal member and outer sleeve.

19. An omnidirectionally tiltable support mechanism comprising means for supporting a mass above a datum plane, a flexure shaft supported by said means for supporting, spaced upper and lower positioning means located intermediate said flexure shaft and said means for supporting, for securing said flexure shaft relative to said means for supporting, and mounting means for connecting the upper end of said flexure shaft to said mass, such that as said mass is tilted, a deflection force acts to tilt the upper end of said flexure shaft within said upper positioning means, so that said flexure shaft deflects between said upper and lower positioning means.

20. The mechanism as defined in claim 19 wherein as said flexure shaft receives a thrust load applied in a substantially axial direction therealong, the thrust load is transferred to said means for supporting at said upper positioning means and is carried to said datum plane by said means for supporting.

21. The mechanism as defined in claim 20 further including adjustment means for altering the flexural rigidity of said flexure shaft.

22. The mechanism as defined in claim 19 wherein said upper and lower positioning means allow said flexure shaft to tilt and swivel relative to said means for supporting.

* * * * *